United States Patent [19]

Gargle

[11] Patent Number: 5,045,978

[45] Date of Patent: Sep. 3, 1991

[54] UNDERWATER LIGHTING FIXTURE

[76] Inventor: Benjamin H. Gargle, 5440 Los Estados, Yorba Linda, Calif. 92689

[21] Appl. No.: 512,533

[22] Filed: Apr. 18, 1990

Related U.S. Application Data

[63] Continuation of Ser. No. 361,241, Jun. 5, 1989, abandoned.

[51] Int. Cl.[5] ..... F21V 33/00

[52] U.S. Cl. ..... 362/101; 362/267; 362/365

[58] Field of Search ..... 362/101, 147, 158, 267, 362/364, 365, 373

[56] References Cited

U.S. PATENT DOCUMENTS

| | | | |
|---|---|---|---|
| 2,163,329 | 6/1939 | Sipior | 40/575 |
| 3,046,388 | 7/1962 | Shinn | 362/267 |
| 3,949,213 | 4/1976 | Paitchell | 362/101 |
| 3,962,675 | 6/1976 | Rowley et al. | 362/101 |
| 4,053,758 | 10/1977 | Shaw | 362/158 |
| 4,156,891 | 5/1979 | Roche | 362/267 |
| 4,368,508 | 1/1983 | Gantenbrink | 362/267 |
| 4,433,366 | 2/1984 | Wade | 362/158 |
| 4,539,629 | 9/1985 | Peppenheimer | 362/267 |
| 4,782,430 | 11/1988 | Robbins et al. | 362/267 |

*Primary Examiner*—Ira S. Lazarus
*Assistant Examiner*—Richard R. Cole
*Attorney, Agent, or Firm*—Michael A. Painter

[57] ABSTRACT

An underwater lighting fixture mounted in an aperture formed in the wall of a spa or other reservoir of water. An open-ended outer housing is disposed in a receiving aperture in the wall, and is secured thereto by a watertight coupling, the opening in the housing being directed to the interior of the enclosure. A light bulb and the electrical connections are mounted within the housing, the interior cavity of the housing being cylindrical and having screwthreads disposed about the inner circumference of the housing. The lens of the lighting fixture is integral with an inner cylindrical housing having screwthreads disposed about the outer circumference thereof and being adapted to engage the receiving screwthreads disposed on the interior surface of the outer housing. The inner housing is rotatably secured by engaging the screwthreads thereby forming a watertight seal therebetween.

2 Claims, 2 Drawing Sheets

UNDERWATER LIGHTING FIXTURE

This is a continuation of application Ser. No. 361,241 filed June 5, 1989, now abandoned.

BACKGROUND OF THE INVENTION

1. Field of the Invention

The invention generally relates to lighting devices, and more particularly to devices used in water reservoirs such as spas or the like.

2. Prior Art

The prior art discloses a number of lighting apparatus adapted to be mounted in underwater environments. The devices taught by the prior art generally fall within two categories:

(a) those adapted to be mounted within inaccessible walls (e.g. swimming pools); and (b) those mounted in Pre-formed structures which provide full access prior to installation (e.g., spas). With respect to underwater lighting assemblies mounted in the walls of fixed water reservoirs, the housing of the lighting assembly is typically secured within an aperture disposed in the concrete of the reservoir wall. The housing shell is adapted to receive an inner housing which includes the light bulb receptacle as well as the connections to the electrical source. In order to service the device and replace the light bulb, the inner housing must be fully disconnected from the outer housing shell and the inner housing disassembled in order to gain access to the interior thereof. One of the inherent problems in this type of device is the plurality of components which must be separately manufactured and used in order to maintain the watertight integrity of the assembly necessary to prevent contact between the water and the electrical components.

With the complexity and expense of the underwater lighting assemblies used for swimming pools, the prior art discloses lighting devices used for preassembled reservoirs of water such as those manufactured for spas, hot tubs and the like. Since the reservoir is an integral structure and is pre-fabricated prior to installation, the outside surface of the reservoir wall is accessible. Since the prefabricated enclosures are generally designed to reduce expenses, the underwater lighting assemblies which are used generally allow light bulb replacement only through access at the rear of the fixture. All components needed to maintain the watertight integrity of the structure are fixed, thereby precluding direct access from the interior of the water reservoir. The problems inherent in this type of device relate to the limited nature of its use. Since maintenance can only be accomplished by rear entry, the device cannot be employed for pre-assembled structures which deny access to the outer wall of the enclosure after installation.

The present invention resolves those problems exhibited by the devices disclosed in the prior art. The present invention can be used on water reservoirs irrespective of whether there is access to the outer wall after installation of the reservoir. An outer housing shell is mounted in the reservoir wall prior to installation. Watertight integrity is maintained between the outer housing and the aperture surface through the use of conventional components. The interior cavity of the outer housing opens into the water reservoir and will typically be below the normal, operating water level. The light bulb is mounted within an electrical socket coupled at the base of the outer housing. The outer housing has a cylindrical inner surface having spiral screwthreads disposed therein. The fixture lens assembly includes an inner cylindrical housing adapted to be received within the cavity of the outer housing and to be coupled thereto. Mating, spiral screwthreads are disposed about the outer cylindrical surface of the inner housing, the screwthreads engaging those disposed in the inner surface of the outer housing shell. The present invention provides watertight integrity preventing contact between the water and the electrical circuits and allowing for maintenance irrespective of whether installation precludes access to the outer wall of the reservoir.

SUMMARY OF THE INVENTION

The present invention relates generally to an underwater lighting fixture, providing watertight integrity and permitting use irrespective of whether it is used in installations which preclude access to the outside wall of the mounting enclosure. An outer housing shell is mounted within an aperture of the wall of a spa, hot tub or the like. The outer housing shell is substantially cylindrical, the base end being enclosed. An electrical socket is mounted within the base of the outer housing shell and is adapted to receive a suitable light bulb. An integral flange extends outwardly from the upper end of the outer housing shell, the flange extending beyond the edge of the aperture into which the outer housing shell is disposed. Spiral screwthreads are disposed about the outer cylindrical surface of the outer housing shell. When installed, an appropriate gasket is disposed between the flange and the inner surface of the reservoir wall. An annular, locking member is disposed about the outer surface of the housing shell having mating, spiral screwthreads which allow the locking member to be forced against the outer surface of the reservoir wall tightly drawing the flange and gasket against the inner surface of the wall.

Spiral screwthreads are disposed about the cylindrical inner surface of the outer housing shell. The fixture lens assembly includes an integral cylindrical member, having spiral screwthreads disposed about the outer surface thereof which are adapted to engage the screwthreads disposed in the inner cylindrical surface of the housing shell. The lens member is substantially aligned with the flange. A resilient gasket is disposed between the lens and the flange. By rotating the lens assembly, the lens and gasket are drawn tightly against the flange creating a watertight seal.

It is therefore an object of the present invention to provide an improved lighting assembly for underwater applications.

It is another object for the present invention to provide an improve underwater lighting apparatus allowing access from the front thereof.

It is still another object of the present invention to provide an improved lighting apparatus for use in Prefabricated spas, hot tubs or the like.

It is still yet another object of the present invention to provide an improved underwater apparatus which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently Preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
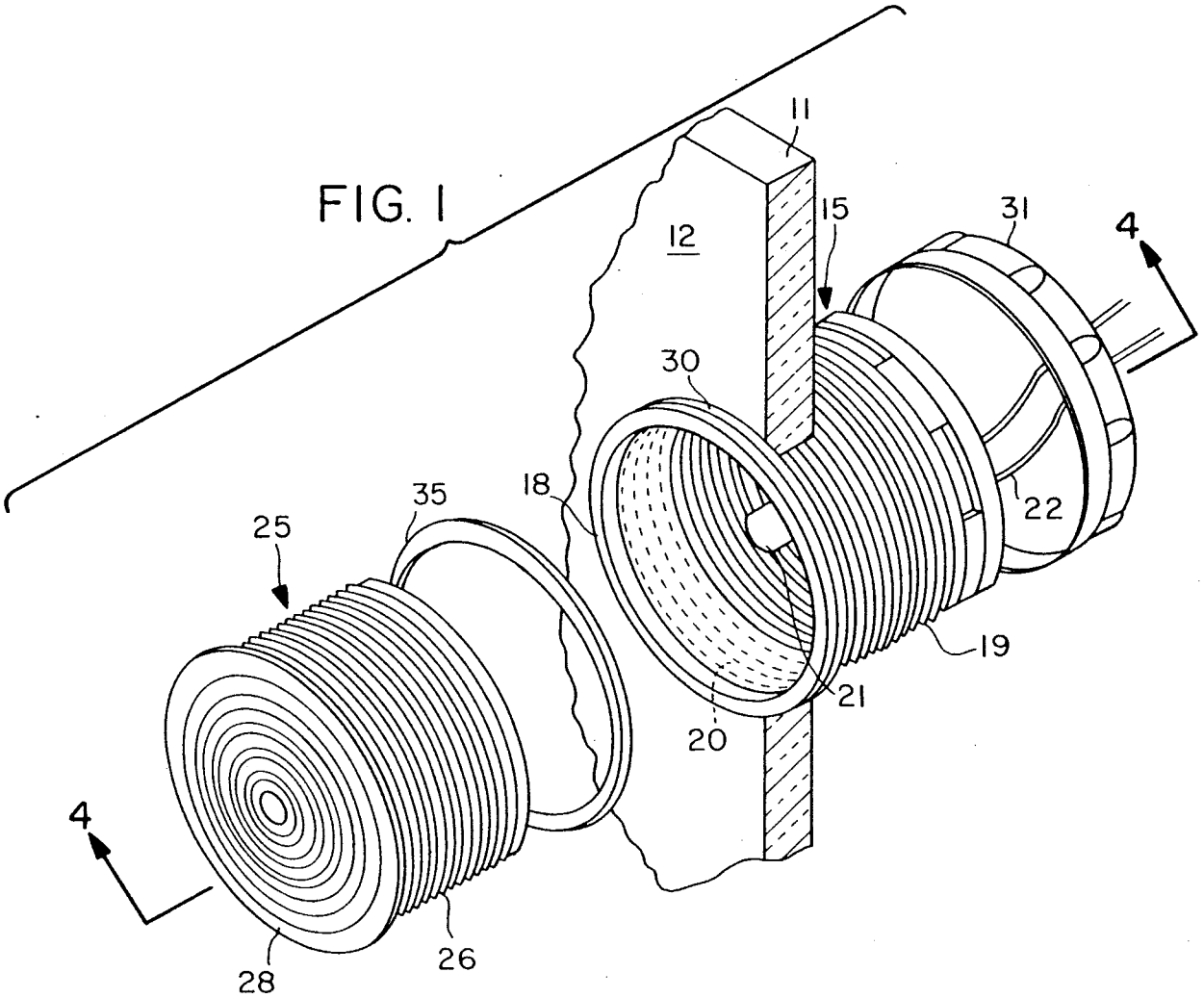
FIG. 1 is an enlarged, exploded, perspective view of an underwater lighting apparatus in accordance with the present invention.

An understanding of the present invention underwater lighting fixture can be best gained by reference to FIG. 1 wherein an exploded, assembly view of the present invention is shown, the fixture designated by the reference numeral 10. The present invention lighting fixture 10 is used in structures such as spas, hot tubs, and the like which are prefabricated prior to installation, and have fixed enclosure walls 11, with the opposing inner and outer wall surfaces 12 and 13 thereof being accessible prior to installation.

An aperture 14 is disposed through wall 11 which is adapted to receive cylindrical outer housing shell 15. Outer housing shell 15 comprises a substantially cylindrical body having an enclosed base 16 and an interior cavity 17 which opens to the interior of the water reservoir. The open end of outer housing shell 15 has an integral, circular flange 18 extending outwardly therefrom. The outer circumference flange 18 is greater than the circumference of aperture 14.

Both the inner and outer cylindrical surfaces 20 and 21 of housing shell 15 have spiral screwthreads disposed therein. As can be seen best in FIG. 4, base end 16 has a central aperture formed therein for mounting a conventional light bulb 21 and socket assembly 22. Since in operation light bulb 21 will generate heat, vents 23 are disposed about the circumference of housing shell 15 substantially adjacent base 16 in order to provide channels to dissipate the generated heat.

As will be discussed in detail hereinbelow, inner housing and lens assembly 25 is adapted to be coupled to outer housing shell 15. The cavity 17 is defined by the cylindrical inner surface 20 of housing shell 15. A portion of the inner cylindrical surface 20 has spiral screwthreads disposed therein which are adapted to engage the mating, spiral screwthreads formed about outer surface 26 of housing and lens assembly 25. Housing and lens assembly 25 comprises a cylindrical body defined by its outer surface 26 and inner surface 27. Lens member 28 is integral with cylindrical body 26 and is concentric with the axis of cylindrical body 26. Lens member 28 is preferably circular in shape and is in substantial alignment with flange 18 when housing and lens assembly 25 is coupled to housing shell 15.

Figure 4:
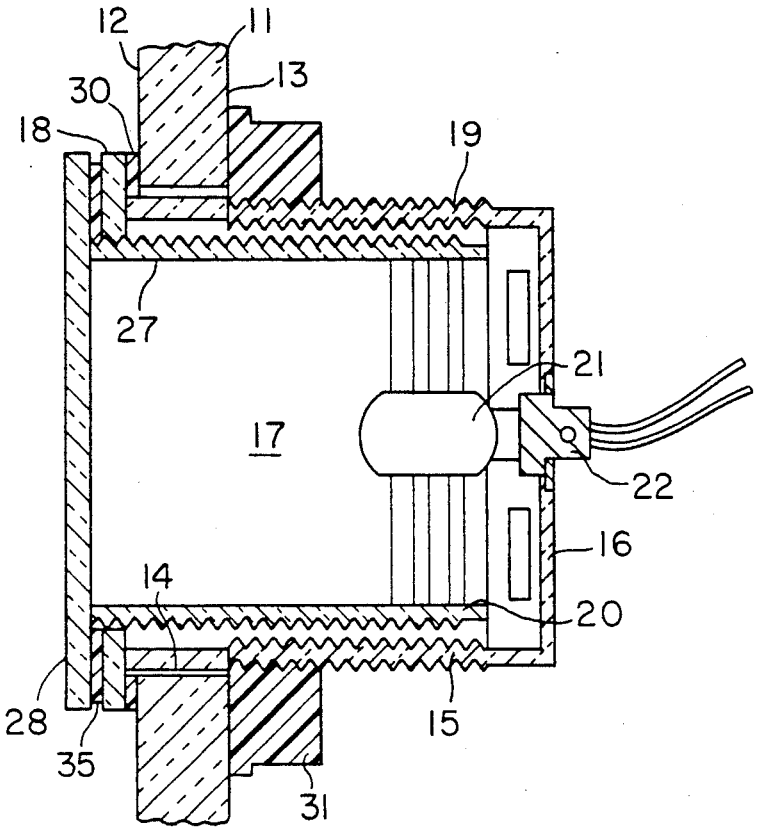
FIG. 4 is a side elevation, cross sectional view of the present invention underwater lighting apparatus taken through line 4—4 of FIG. 1.
Figure 3:
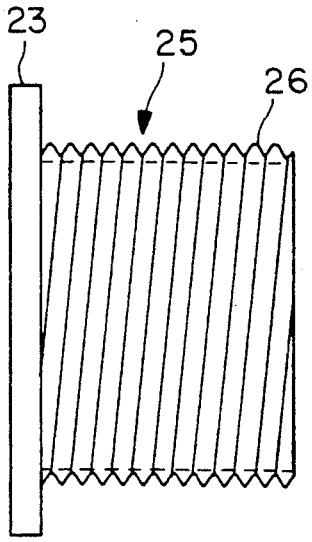
FIG. 3 is a side elevational view of the inner housing and lens assembly shown in FIG. 1.
Figure 2:
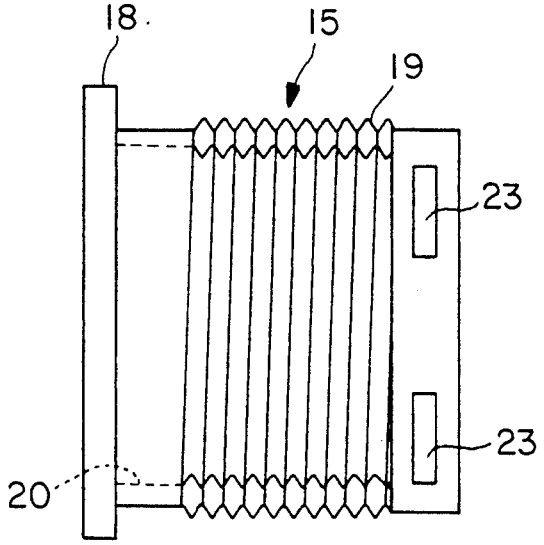
FIG. 2 is a side elevational view of the outer housing shell shown in FIG. 1.

Assembly of the components of the present invention can be best seen by reference to FIG. 1 and FIG. 4. As stated, one of the objectives of the present invention is to provide and underwater lighting fixture that is maintainable irrespective of whether rear access is possible after installation. The preferred embodiment can be used for spas, hot tubs or the like, each of which are pre-assembled prior to installation. The water reservoir is defined by wall 11. To mount the present invention, an aperture 14 is disposed through wall 11, aperture 14 being adapted to be concentric with outer surface 19 of outer housing shell 15. When assembled, a gasket 30 of a suitable, resilient material such as rubber is used to create a water tight seal. The gasket 30 is adapted to extend about the outer surface 19 of outer housing assembly 15. Gasket 30 is placed substantially adjacent flange 18 and is co-extensive with the outer edge of flange 18. When mounted, the cylindrical surface 19 of fixture 10 extends through aperture 14 until gasket 30 is disposed between and in firm contact with wall surface 12 of wall 11 and flange 18 of outer housing shell 15.

Annular locking member 31 is provided with spiral screwthreads 32 along its inner circumference which are adapted to engage the screwthreads in outer surface 19 of housing shell 15. Annular locking member 31 is rotated until in contact with wall surface 13. The force imposed by locking member 31 on wall surface 13 will firmly urge flange 18 against gasket 30 creating a watertight seal thereby Preventing contact between the reservoir of water and electrical socket 22.

A gasket 35 of suitable resilient material such as rubber is adapted to be disposed about outer cylindrical surface 26 substantially adjacent lens member 28. When assembled, cylindrical body 26 is disposed within cavity 17 of outer housing shell 15, the spiral screwthreads disposed in cylindrical surface 26 engaging the mating screwthreads disposed in inner surface 20. Housing and lens assembly 25 is rotated to further engage the mating screwthreads and until gasket 35 is tightly clamped between flange 18 and lens member 28.

In operation, the present invention provides the means to change light bulb 21 irrespective of whether installation of the fixture prevents access to base 16, the mounted electrical socket 22 or light bulb 21. The interior cavity 17 is accessible at the inner wall surface 12 of wall 11. Maintenance can be accomplished by lowering the water level below lens 28. Housing and lens assembly 25 is removed thereby giving access to cavity 17. After replacing light bulb 21, the watertight seal is again formed by tightly engaging gasket 35 intermediate flange 18 and lens member 28.

I claim:

1. An underwater lighting fixture for use in a water enclosure defined by an integral wall providing access after installation of the enclosure only to an interior surface thereof comprising:

(a) an outer housing shell having a body defining inner and outer cylindrical surfaces and an open forward end and a closed base end thereof, an outwardly extending circular flange being integral with the forward end, and screwthreads disposed uniformly upon the inner surface, the body being adapted to be disposed through an aperture in the wall, the forward end being in communication with the water enclosure;

(b) a lamp axially mounted in the base end of said outer housing shell;

(c) a first sealing gasket disposed about the outer cylindrical surface of the body and being substantially adjacent to and in firm contact with the flange;

(d) an annular locking member removeably coupled about the outer surface of the body and adapted to urge said sealing gasket into forced engagement between the flange and the wall;

(e) a lens assembly having a cylindrical body having first and second ends and a circular lens member enclosing the first end and concentrically extending outwardly therefrom, the inner surface of said cylindrical body at the second end thereof being disposed about said lamp, the outer surface of the cylindrical body of said lens assembly being adapted to be disposed within the forward end of, and be in engagement with the spiral screwthreads in the inner cylindrical surface of the body of said outer housing shell whereby the disengagement of said lens assembly from said outer housing shell allows replacement of the lamp from the interior surface of said water enclosure; and (f) a second sealing gasket disposed about the cylindrical body of said lens assembly and adapted to be place din forced engagement with the flange and the lens member creating a watertight seal.

2. An underwater lighting fixture as defined in claim 1, wherein spiral screwthreads are uniformly disposed about the outer surface of the cylindrical body of said outer housing shell, said annular locking member adapted to be in engagement with the screwthreads in the outer surface of the cylindrical body of said outer housing shell.

* * * * *